United States Patent [19]

Peterson

[11] Patent Number: 4,702,094

[45] Date of Patent: Oct. 27, 1987

[54] ELECTRIC SOLENOID OPERATION VEHICLE HOOD LOCK

[75] Inventor: Larry O. Peterson, Reseda, Calif.

[73] Assignee: Crimestopper Security Products, Inc., Simi Valley, Calif.

[21] Appl. No.: 802,424

[22] Filed: Nov. 27, 1985

[51] Int. Cl.[4] ..... E05B 65/19

[52] U.S. Cl. ..... 70/241; 70/257; 70/283; 180/289; 200/43.01; 292/DIG. 14; 292/DIG. 25; 292/DIG. 42; 307/10 AT; 361/187

[58] Field of Search ..... 70/241, 279, 271, 256, 70/283, 237, 257, 282, 264, 240, DIG. 30; 292/144, 201, DIG. 14, DIG. 25, DIG. 42; 180/287, 289; 307/10 AT; 361/187; 200/43.01, 43.16, 321; 335/254

[56] References Cited

U.S. PATENT DOCUMENTS

| | | | |
|---|---|---|---|
| 2,206,137 | 7/1940 | Tedtman | 292/DIG. 14 X |
| 2,469,283 | 5/1949 | Steele | 292/201 |
| 3,083,562 | 4/1963 | Weizer | 70/271 |
| 3,576,119 | 4/1971 | Harris | 70/271 |
| 3,744,285 | 7/1973 | Barmherzig | 70/241 |
| 3,820,361 | 6/1974 | Leitner | 70/241 |
| 3,831,408 | 8/1974 | Featherman | 70/279 X |
| 4,102,164 | 7/1978 | Barbush | 70/241 |
| 4,233,642 | 11/1980 | Ellsberg | 70/241 X |
| 4,430,685 | 2/1984 | Ellsberg | 70/241 X |

FOREIGN PATENT DOCUMENTS

| | | | |
|---|---|---|---|
| 2116448 | 10/1972 | Fed. Rep. of Germany | 70/241 |

*Primary Examiner*—Robert L. Wolfe
*Assistant Examiner*—Lloyd A. Gall
*Attorney, Agent, or Firm*—Leonard Tachner

[57] ABSTRACT

A solenoid activated locking system primarily for hood and trunk manual release systems for vehicles. The solenoid is connected to a cable tied to the latch of a conventional hood or trunk release system. Unless activated, the solenoid prevents manual release of the trunk or hood lids to prevent access to the truck or engine compartment to someone who has obtained unauthorized access to the vehicle interior. The solenoid is automatically actuated for a preselected period of time whenever the ignition is turned on or off or when a reset switch is closed for more than a minimum and less than a maximum period of time. In addition, the solenoid is activated automatically during closure of the hood or trunk lid to permit secure engagement of the corresponding latch mechanism. An emergency release cable, hidden in an obscure location external of the vehicle, is provided for enabling manual release of the solenoid in the event of vehicle battery failure or other otherwise disabling event.

7 Claims, 5 Drawing Figures

ELECTRIC SOLENOID OPERATION VEHICLE HOOD LOCK

BACKGROUND OF THE INVENTION

1. Field of the Invention

The present invention relates generally to the field of electrically controlled locking systems and more particularly, to a solenoid operated electric hood or trunk locking system for vehicles designed to automatically lock or unlock the hood or trunk of a vehicle through the factory provided release mechanism and the vehicle's ignition switch. Furthermore, the invention is characterized by a solenoid lock which releases for a period of 30 seconds before relocking thereby making it impossible for a user to inadvertently leave his hood or trunk of his vehicle unlocked. The solenoid releases for 30 seconds when one of three different possible conditions occur, namely, the ignition key is turned on or off, the hood is closed from an open position or a reset switch is turned on for a selected period of time.

2. Prior Art

The general concept of locking the hood of the vehicle is old in the art. By way of example, U.S. Pat. No. 4,102,164 to Barbush is directed to theft prevention system for a vehicle which automatically locks the hood of the vehicle and disables the ignition system of the vehicle when the engine is turned to an off condition. However, this system fails to disclose any form of time delay system which is an important feature of the present invention. U.S. Pat. No. 3,538,725 to Guenther, et al discloses still another automobile hood locking device and renders the ignition system of the automobile operative or inoperative in response to a displacement of a remotely controlled bolt for locking the hood. Here again there is no provision for a time delay feature. U.S. Pat. No. 4,233,642 to Ellsberg is directed to a safety interlock system for vehicles which includes a hood lock. Although this system uses a preselected code input for actuation of the locking system and provides means for time delay under controlled conditions, the patent is not directed to the coupling of the delay timing mechanism for a hood lock as provided in the present invention. Ellsberg does not have any provision for emergency release of his hood lock in the event of vehicle battery failure.

SUMMARY OF THE INVENTION

The electric hood and trunk lock system of the present invention is designed to automatically lock and unlock the hood or trunk of the vehicle by means of the factory release mechanism and the vehicle's ignition switch. The present invention is unique in both its automatic lock-unlock operation and in its emergency release cable. The system utilizes a solenoid lock which releases for 30 seconds before relocking thereby making it impossible for the user to inadvertently leave the hood or trunk unlocked. The solenoid of the present invention is controlled by a control module to release the hood or trunk lock for a period of 30 seconds or other selected period of time if any one of the following conditions occurs: the ignition is turned on or off, (this eliminates the need for an extra key lock cylinder or toggle switch to operate the locked solenoid); the hood is closed from a previously open position, (this is necessary on most vehicles to allow the hood to close; it is accomplished in the present invention by means of a plunger switch beneath the hood; as the hood closes the plunger switch is depressed, immediately releasing the locked solenoid); a reset switch is on for more than one second but less than six seconds, (a reset switch can be any switched 12 volt source in the vehicle such as parking lights or defroster switch, the reset switch will release the locked solenoid only when the ignition has been on longer than 30 seconds thereby allowing the hood or trunk to be opened while the engine is running).

The principal components of the present invention are adapted to interface with available components within the vehicle and include a control module, a hood switch, a solenoid block and a hood release enable cable, the latter being adapted for connection to the hood latch or to the inside hood release cable to operate in conjunction therewith for allowing the hood or trunk to be opened under certain limited conditions. These limited conditions include, turning the ignition key on or off indicating that the user is already within the vehicle and when a reset switch is turned on for a selected period of time such as greater than one second and less than six seconds. This allows the hood or trunk to be opened while the engine is running and without requiring the user to turn off the ignition which would otherwise be an inconvenience. Finally, the hood mechanism of the present invention allows the hood latch to be operated for closing the hood which is a requirment on most vehicles. Of course, because the hood is already opened, enabling the hood latch mechanism in this configuration does not detract from the theft-resistance of the present invention.

Only when the solenoid of the present invention is released is it possible for the user of the vehicle to manually release the hood by means of the conventional inside hood release mechanism available in most vehicles. The present invention may also be employed with vehicles which provide interior trunk release devices in the same manner as described hereinbelow for the hood release mechanism. In fact, the present invention may be utilized concurrently for enabling the user to operate conventional manual hood release and trunk release mechanisms within the vehicle in a conventional manner after the solenoid of the present invention has been released by utilizing two such solenoids, one connected to the hood latch mechanism and one connected to the trunk latch mechanism.

OBJECTS OF THE PRESENT INVENTION

It is therefore a principal object of the present invention to provide an electric hood and trunk lock system to automatically lock and unlock the hood or trunk of a vehicle through the conventional factory release mechanism and the vehicle's ignition switch.

It is an additional object of the present invention to provide an electrically controlled locking system which denies access to the interior of a vehicle's trunk or engine compartment even when an unauthorized individual has obtained access to the interior of the vehicle, by utilizing a solenoid controlled locking system which denies operability of the conventional factory release mechanism except for limited periods and under limited conditions, all of which conditions would indicate that the vehicle interior is occupied by an authorized individual.

It is still an additional object of the present invention to provide a solenoid release mechanism for selectively enabling or disenabling the factory release mechanism for the hood or trunk of a vehicle, the solenoid being released for a limited period of time when the ignition key is turned on or off, when a reset switch is turned on for a limited period of time or when the hood or trunk is in the process of being closed.

It is still an additional object of the present invention to provide an electric hood and trunk lock system which comprises an emergency release cable which is hidden in some externally accessible but obscure location on a vehicle whereby a user who knows the location of such a cable can enable the hood release mechanism even if the vehicle battery has failed.

It is still an additional object of the present invention to provide a hood or trunk locking system which, if interfaced with an alarm that has an ignition disable circuit, cannot be released until the alarm system has been turned off or disabled.

BRIEF DESCRIPTION OF THE DRAWINGS

The aforementioned objects and advantages of the present invention as well as additional objects and advantages thereof will be more fully understood hereinafter as a result of a detailed description of a preferred embodiment of the invention when taken in conjunction with the following drawings in which.

DETAILED DESCRIPTION OF A PREFERRED EMBODIMENT

Figure 1:
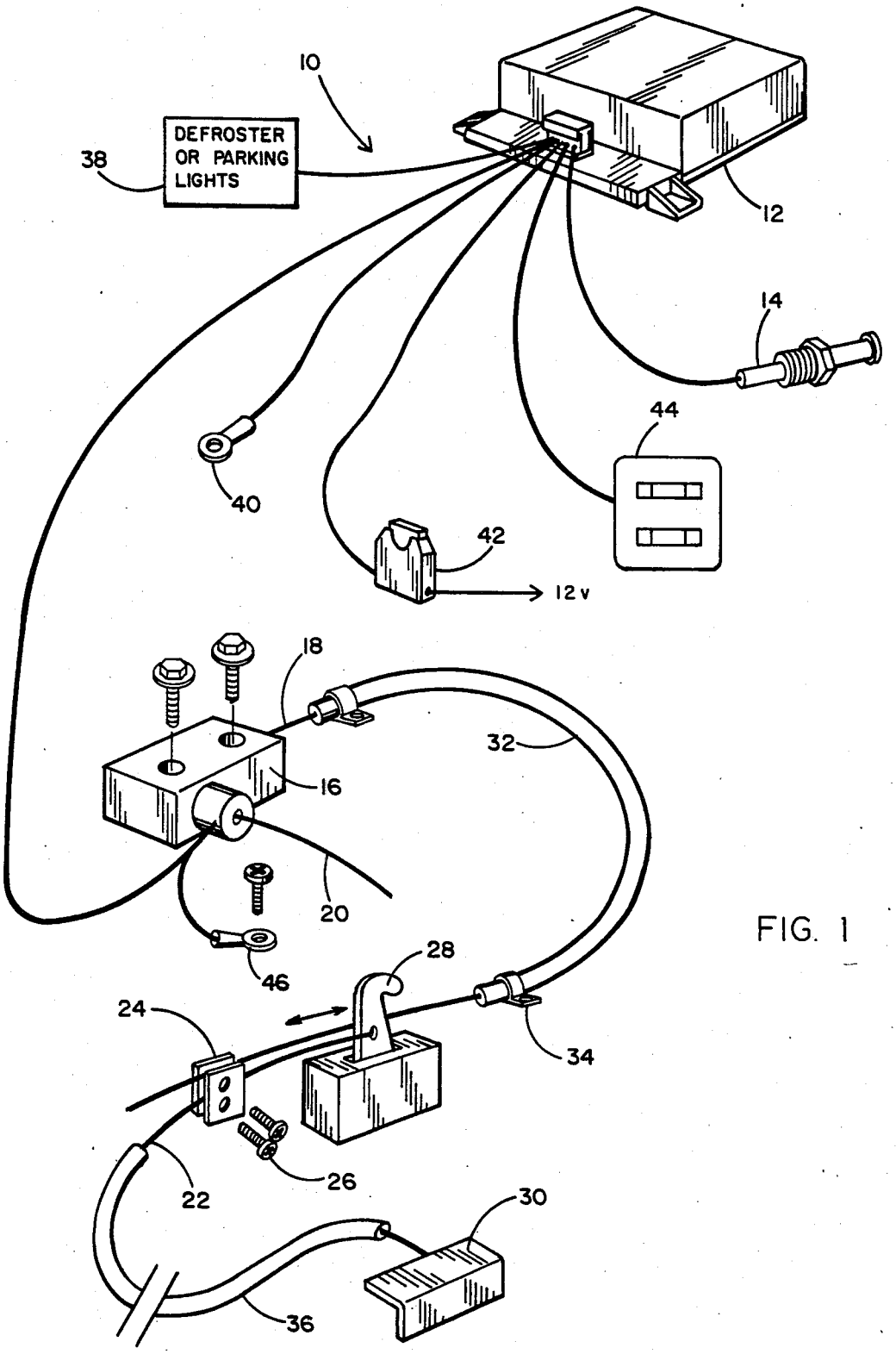
FIG. 1 is a simplified system illustration of the present invention illustrating the manner in which the components of the present invention may be connected to the standard components of a vehicle to which the system is to be connected.

Referring first to FIG. 1 it will be seen that the electronic control or blocking system 10 of the present invention comprises a control module 12, a hood switch 14 and a solenoid block 16, the latter having a hood release enable cable 18 and an emergency solenoid release cable 20. As seen further in FIG. 1, the hood release enable cable 18 is adapted for connection to a hood release cable 22 which is normally provided in the vehicle for permitting the user to unlatch the hood by using a hood latch 28 connected to one end of the cable 22 and an inside hood release 30 connected at the other end of the cable 22. Typically, the inside hood release 30 is within the interior of the vehicle thereby permitting the driver to unlatch the hood from inside the vehicle thereby enabling access to the engine compartment only to those who have access to the interior of the vehicle. This factory provided security system is taken one step further in the present invention by providing the present solenoid operated hood release system which prevents activation of the hood release cable 22 even to those who have access to the interior of the vehicle unless they also have an ignition key. This additional security provided by the present prevents access to the engine compartment even to those who may obtain access to the interior of the vehicle by unauthorized means such as by entering a vehicle left unlocked or by those who might enter the vehicle by breaking in or by stealth.

In any case, the manner in which the hood and trunk lock system of the present invention controls the ability of the user inside the interior of the vehicle to unlatch the hood by the inside hood release 30 is shown in the lower portion of FIG. 1. More specifically, as seen in FIG. 1, the hood release enable cable 18 is interconnected to the hood release cable 22. In the particular embodiment illustrated in FIG. 1, this interconnection is provided by means of a clamp 24 and a pair of suitable fasteners such as screws 26. Because of this interconnection, only when the solenoid block 16 is released thereby permitting cable 18 to be extended from the solenoid block is it possible for the user of the present invention to then pull on cable 22 utilizing inside hood release 30 thereby releasing the hood latch 28. In the event solenoid block 16 is not released but is in its locked configuration, cable 18 cannot be extended from the solenoid block 16 thereby preventing release of the hood latch 28 despite attempts to pull on the hood release cable 22. Typically, cables 18 and 22 are provided with flexible sleeves 32 and 36, respectively. In addition, they may be provided with cable clamps such as cable clamp 34 which are connected to the sleeves and are adapted to stabilize the cables to suitable structure of the vehicle so that the cables do not become constricted or otherwise interfered with by other vehicle components.

The solenoid operated hood lock system of the present invention may be operated by merely connecting the solenoid power cables to a suitable voltage source such as by using a hidden switch after the ignition key has been turned to its on configuration. However, the preferred embodiment of the present invention utilizes a control module 12 shown in the upper-most portion of FIG. 1. A schematic of this control module is provided in FIG. 5 and is discussed hereinbelow. It will be seen in FIG. 1 that the control module 12 is connected to a switchable 12 volt source by means of connecting it to the vehicle's defroster or parking lights switch 38. It is also connected to ground by a suitable ground 40 and to a fixed 12 volt line such as the battery through a 5 amp fuse 42. It is also connected to the ignition or accessory source 44 and to the hood switch 14 which is a component of the present invention and which is discussed hereinafter in conjunction with FIG. 2. Typically, the control module 12 is mounted within the interior of the vehicle such as under the dash or seat but not in the engine compartment. On the other hand, the hood switch 14 and solenoid block 16 are mounted underneath the hood within the engine compartment.

Figure 2:
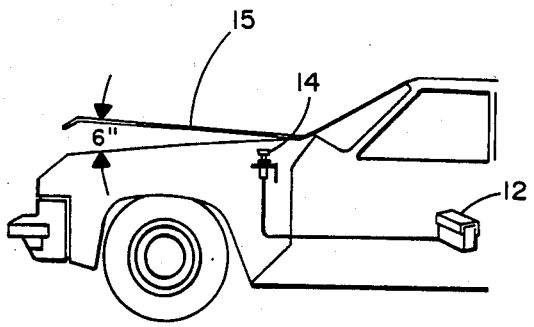
FIG. 2 is a simplified view of a vehicle illustrating the manner in which the hood switch of the present invention may be installed.

FIG. 2 illustrates the preferred position for mounting the hood switch 14 with respect to the hood 15. More specifically as seen in FIG. 2, it will be seen hereinafter that the hood switch 14 is configured so that the switch connects the selected junction of the control module 12 to ground potential when the hood is open and disconnects that junction from ground when the hood is closed. Furthermore, as indicated in FIG. 2 the hood should be able to travel from its fully closed position to an open position about six inches at the free end of the hood before the switch 14 is grounded. Therefore, the six inch opening will be the same position for ungrounding the switch 14 when the hood is lowered into its closed position thereby activating the solenoid release of the present invention as described hereinafter.

Figure 3:
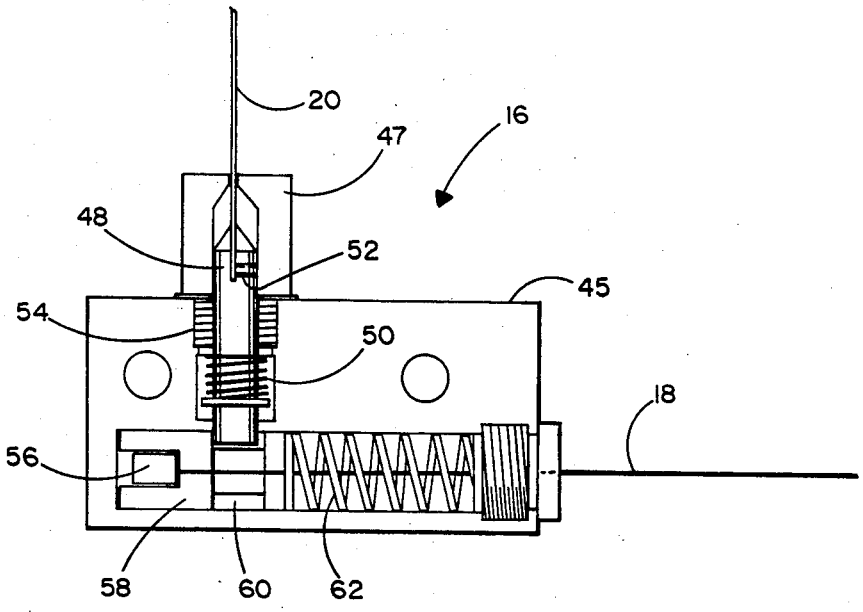
FIG. 3 is a cut-away view of the solenoid block of the present invention illustrating the manner in which the hood release enable cable and emergency solenoid release cable of the present invention operate.
Figure 4:
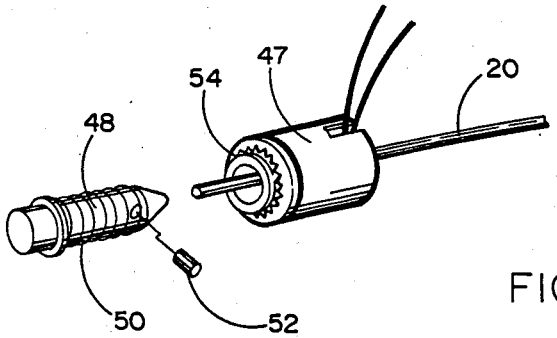
FIG. 4 is an exploded view of the plunger and solenoid portion of the solenoid block of the present invention illustrating the manner in which they are connected to the emergency release cable.

Reference will now be made to FIGS. 3 and 4 for a more detailed description of the solenoid portion of the present invention. As shown in FIGS. 3 and 4, the solenoid block 16 comprises a housing 45 in which is contained a solenoid 47 having a plunger 48 and a spring 50. The solenoid 47 is connected to the housing 45 by means of a threaded connection 54. The hood release enable cable 18 is connected to a cable end cap 56 which is encircled by a guide 58 which is secured within the housing 45 bearing against a spring 62. As seen best in FIG. 3, the guide 58 is provided with an annular recess 60 into which the plunger 48 normally extends when the solenoid 47 is in its unactivated configuration. Those having skill in the art to which the present invention pertains will appreciate that when the plunger 48 extends into the recess 60 of the guide 58, the plunger prevents movement of the guide thereby preventing movement of the cable end cap 56 to which the hood release enable cable is attached. Furthermore, because the cable 18 is connected to the hood latch 28 as described previously in conjunction with FIG. 1, the inside hood release 30 of FIG. 1 cannot be activated and the hood cannot be opened despite access to the hood release mechanism in the interior of the vehicle. It will be understood that the plunger 48 is forced upward as seen in FIG. 3 against the pressure of spring 50 in response to activation of the solenoid 47. Accordingly, upon activation of the solenoid, the plunger 48 is withdrawn from the annular recess 60 of the guide 58. Consequently, activation of the solenoid 47 permits movement of the guide 58 and therefore the cable 18, permitting the release of the hood latch by conventional activation of the hood release cable 22 of FIG. 1.

One of the novel features of the present invention is an emergency release cable 20 which permits manual withdrawal of the plunger 48 from the annular recess 60 of guide 58 in the event that the locking system of the present invention becomes disabled such as by complete discharge of the vehicle's battery. More specifically, as shown in FIGS. 3 and 4 the emergency release cable 20 is connected to the plunger 48 by means of a set screw 52 whereby manual tension applied to the cable 20 will cause the plunger 48 to move upwardly in the same direction that it would normally move upon activation of the solenoid 47. Typically, the emergency release cable 20 is channeled to an accessible but still obscure location beneath the vehicle where it can be accessed for activation by someone who knows precisely where it is positioned.

As previously indicated, the control module 12 of the present invention seen in FIG. 1 controls the conditions upon which the solenoid 47 of the solenoid block 16 will be activated. As previously described, these conditions in the particular embodiment described herein will result in release of the solenoid for a period of 30 seconds when either of three different criteria are met. The first such criterion is the ignition key being turned on or off. This condition eliminates the need for an extra key lock cylinder or toggle switch to operate the solenoid of the present invention and allows the vehicle operator to gain access to the engine compartment by using the conventional inside hood release within 30 seconds of either turning on or turning off the ignition. The second criterion is closure of the hood. This is necessary on most vehicles to allow the hood to close. In other words, the hood latch in most vehicles must be operable in order to assure that the hood is securely closed. This is accomplished in the present invention through the plunger switch or hood switch 14 previously described in conjunction with FIGS. 1 and 2. As the hood closes, the plunger switch 14 is depressed, immediately releasing the solenoid. The third and final criterion for activation of the solenoid 47 is activation of a reset switch for a period of time which falls within a time window having a minimum of one second and a maximum of six seconds.

Although a dedicated switch can be installed in the vehicle for this purpose, it has been found that any switch to the 12 volt source of the vehicle can be employed for this secondary purpose. By way of example, the parking lights or defroster switch can be employed for the reset operation. The reset switch will release the solenoid only when the ignition has been on for a period greater than 30 seconds. This permits the hood or trunk to be opened while the engine is running.

Figure 5:
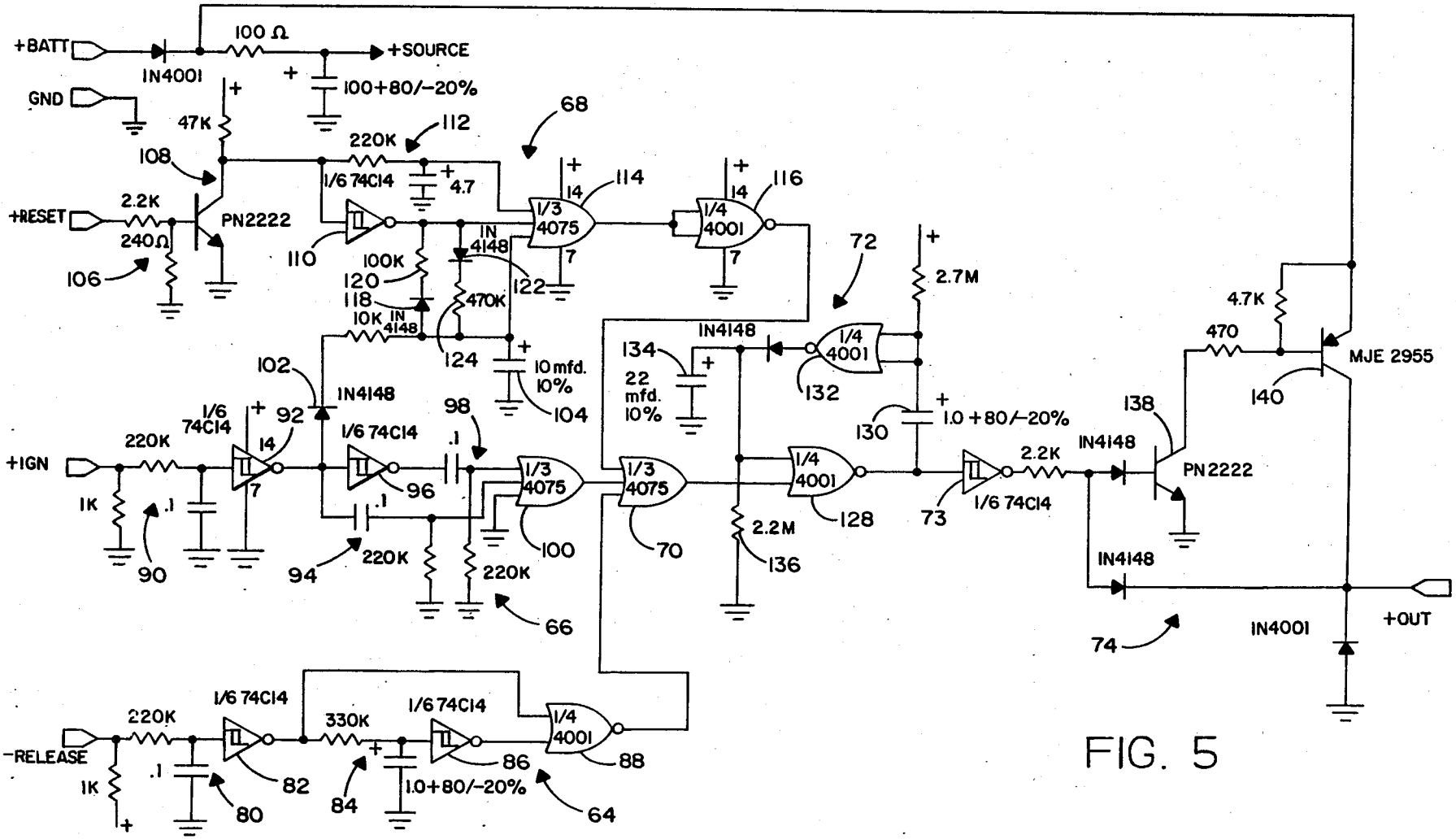
FIG. 5 is a detailed schematic diagram of the control module of the present invention.

The electronic circuitry of the control module 12 is represented by the schematic of FIG. 5. Basically, it will be seen that the circuit of FIG. 5 is a combination of logic components and other circuit elements which respond to the aforementioned conditions presented to the circuit as the inputs, "reset", "ignition" and "release", respectively to provide an output to the solenoid 47 when the conditions are satisfied and for a selected period of time as will be hereinafter more fully described. The hood switch 14 of FIG. 1 is connected to logic circuit 64. The ignition key circuit of FIG. 1 is connected to logic circuit 66. The reset switch of FIG. 1 is connected to logic circuit 68. The output from each of these logic circuits 64, 66 and 68 is connected to one input of a OR gate 70. The output of OR gate 70 is connected to a logic circuit 72 the output of which is connected to the output circuit 74 through a Schmitt trigger inverter 73. The logic of FIG. 5 operates between approximately +5 volts which is the voltage level of a logical 1 and ground potential which is the voltage level of a logical 0. The three input logic circuits 64, 66 and 68 respond to the various solenoid activation conditions to generate a logical 1 which is applied to the OR gate 70 which in turn, will generate a logical 1 at its output applied to the logic circuit 72.

The hood switch release logic circuit 64 of FIG. 5 comprises an RC circuit 80, a Schmitt trigger inverter 82, an RC circuit 84, an additional Schmitt trigger inverter 86 and a NOR gate 88. As previously indicated the hood switch 14 is connected to ground when the hood is opened and is disconnected from ground as the hood is closed and passes a point approximately 6 inches from the closed position. Thus, when the hood is closed the input applied to the logic circuit 64 comprises initially a ground potential which is raised to +12 volts upon removal of the ground due to the connection of the input to the voltage source through a 1 KOhm resistor. The positive-going signal is applied to the RC circuit 80 which, in effect, slows down the transition from 0 to +5 volts before the signal is applied to a Schmitt trigger inverter 82.

The output of the Schmitt trigger inverter is connected directly to one input of the NOR gate 88 and is also connected to a second input of the NOR gate 88 through the RC circuit 84 and another Schmitt trigger inverter 86. The function of RC circuit 84 is to slow down further the transition of the input signal and the inverter 86 inverts the signal so that the two inputs to the NOR gate 88 are of opposite transition polarity.

However, the input from the Schmitt trigger 82 is applied to the NOR gate 88 earlier because of the presence of the RC circuit 84 in the other input to the NOR gate 88. Consequently, there is a limited period of time during which both inputs to NOR gate 88 are negative between the first voltage transition applied to the upper input to the NOR gate and the second voltage transition applied to the lower input to the NOR gate. During this short period of time the NOR gate will generate a positive-going pulse which then returns to 0. This positive-going pulse is applied as one input to the OR gate 70. Thus, the effect of the hood release switch 14 upon closing the hood is to produce a short pulse of the appropriate polarity applied to OR gate 70 which, it will be seen hereinafter, is one condition for initiating an output for activating the solenoid 47 of FIG. 3.

The ignition logic circuit 66 comprises an RC circuit 90, a Schmitt trigger inverter 92, a Schmitt trigger inverter 96, a pair of RC circuits 94 and 98, respectively and a three input OR gate 100. The principal purpose of logic circuit 66 is to generate a positive output from OR gate 100 when the ignition is turned either on or off. RC circuit 90 simply slows down the transition. Schmitt trigger inverter 92 inverts the signal which is applied to the RC circuit 94, the effect of which is to apply a short positive signal to one of the inputs to the OR gate 100. When the ignition switch is being turned off from a previous "on" configuration, the other output of inverter 92 is applied to inverter 96 and the output of inverter 96 is applied to an identical RC circuit 98. The function of RC circuit 98 is to apply a short positive signal to OR gate 100 when the ignition is turned on from a previously off position. Thus, irrespective of whether the ignition is turned on or off, a short positive-going signal is applied to OR gate 100 and a corresponding positive signal is generated at the output of OR gate 100 and applied to a second input of OR gate 70.

Reset circuit 68 comprises an RC circuit 106, a transistor circuit 108, a Schmitt trigger inverter 110, an RC circuit 112, an OR gate 114, a NOR gate 116, a diode 118 in series with a 100 KOhm resistor 120 and a diode 122 in series with a 470 KOhm resistor 124. Circuit 68 also comprises a 10 microFarad capacitor 104 connector to the ignition circuit 66 through a diode 102. Clearly, the output of logic circuit 68 at the NOR gate 116 must be positive for at least a short period of time in order to activate the solenoid 47 of FIG. 3. Because gate 116 is a NOR gate, in order for it to generate a positive output, the input to the NOR gate must be negative. Therefore, only when all of the three inputs to OR gate 114 are negative concurrently will the output of the circuit 68 be positive.

Initially, when the reset input to circuit 68 is grounded, that is, the reset switch has not been activated, the transistor of transistor circuit 108 will be opened because the base-to-emitter bias voltage applied to the transistor will not be sufficient to turn it on. Consequently, the voltage level applied to the input to Schmitt trigger inverter 110 will be positive and the output of the inverter 110 will be negative. Thus, the uppermost input to OR gate 114 will be positive, the middle input will be negative and the lowermost input will depend upon the condition of capacitor 104. If the ignition is turned off at this point, the output of Schmitt trigger 92 of circuit 66 will be positive, thereby charging capacitor 104 through the diode 102 and consequently, the lowermost input to OR gate 114 will also be positive. Accordingly, when the ignition is off, irrespective of the condition of the reset switch, the output of OR gate 114 will remain positive and there will be no activation of the solenoid due to the change in reset in the configuration of the reset switch. Furthermore, even though the capacitor 104 would have a tendency to discharge through the diode 118 and the resistor 120 while the reset switch is off, the time constant for charging the capacitor 104 through the diode 102 from the ignition circuit 66 is shorter and therefore the capacitor will remain substantially fully charged to the +5 volt level. However, if the ignition is turned on the voltage level at the output of inverter 92 of circuit 66 will become negative and the capacitor 104 will have an opportunity to discharge through diode 118 and resistor 120 eventually presenting a negative input to the lowermost input of OR gate 114.

Thus it will be seen that capacitor 104 is principally designed to make the reset circuit 68 conditioned upon the status of the ignition input to the circuit 66 whereby only if the ignition has been for a preselected minimum period of time will the logic circuit 68 be capable of generating an output which will activate the solenoid 47 of FIG. 3.

Assuming that the ignition has been on for the selected minimum period of time, capacitor 104 will be substantially discharged and the lowermost input to OR gate 114 will be negative. Upon activation of the reset input to the RC circuit 106, transistor circuit 108 will turn on thereby reducing the voltage at the collector of the transistor of that circuit to substantially ground potential allowing the capacitor of the RC circuit 112 to discharge and after one second it will be sufficiently discharged so that the uppermost input to OR gate 114 will be negative. At the same time the output of inverter 110 becomes positive and will remain positive as long as the reset input is applied to circuit 68. The positive output of inverter 110 will charge capacitor 104 through diode 102 and resistor 124 and after approximately six seconds, capacitor 104 will be sufficiently charged to change the lowermost input to OR gate 114 to positive again thereby removing any opportunity for the output of circuit 68 to be positive and activate the solenoid 47. However, if the reset input to circuit 68 is turned off prior to the expiration of that six second period, the third and final input to the OR gate 114, that is, the middle input provided at the output of inverter 110 will also be negative thereby satisfying all the conditions for generating a negative output at OR gate 114 and a positive output at NOR gate 116. Thus, the reset circuit 68 will generate an output if the ignition switch has been turned on for a preselected minimum period of time and the reset switch is activated for a period of time between about one second and about six seconds.

If any one of the three inputs to OR gate 70 is positive, the output of OR gate 70 is also positive. Prior to the generation of positive output from the OR gate 70 the lowermost input to NOR 128 of circuit 72 is negative. Consequently, the output of NOR gate 128 is steady state and no current passes through capacitor 130. As a result, the voltage level at the input to NOR gate 132 is positive and the output of the NOR gate 132 is negative thereby applying a second negative input to NOR gate 128. Thus, the steady state value of NOR gate 128 is a positive value. When the output of OR gate 70 goes positive the output of NOR gate 128 suddenly goes negative and the transition between the positive and negative signal levels at the output of NOR gate 128 produces current through capacitor 130 thereby at least temporarily driving the voltage level at the input to NOR 132 down to a logic 0. As a result, the output of NOR gate 132 goes positive, charging capacitor 134 and applying a positive voltage to NOR gate 128 at its uppermost input terminal. After the positive output of OR gate 70 has become negative due to the removal of a positive signal into the OR gate 70 as previously described in conjunction with circuits 64, 66 and 68, the lowermost input terminal to NOR 128 will go negative. However, the output of NOR gate 128 will remain negative until the uppermost input terminal to NOR gate 128 also goes negative. However, this is delayed by the discharge of capacitor 134 through resistor 136 which takes approximately 30 seconds. In the meantime, the negative output of NOR gate 128 is applied to Schmitt trigger inverter 73, the output of which is therefore positive, turning on transistor 138 and allowing current to flow in the collector of that transistor thereby enabling transistor 140 as a current source applied to the output of the circuit of FIG. 5 for activating solenoid 47 of FIG. 3. After capacitor 134 has sufficiently discharged through resistor 136, both input signals to NOR gate 128 are negative and the output of NOR gate 128 becomes positive thereby removing the positive output of the circuit of FIG. 5 and deactivating the solenoid 47.

Those having skill in the art to which the present invention pertains will now understand that what has been disclosed herein comprises a novel and advantageous electronically controlled hood lock system which employs a solenoid and cable interface for securing the hood latch of a vehicle so that it cannot be unlatched despite the presence of an inside hood release device within the vehicle interior. Furthermore, it will be understood that the solenoid of the present invention may be activated thereby releasing the hood latch under certain limited conditions, namely, turning on or off the ignition or with the ignition on for at least 30 seconds, activating a reset switch for a period of time that falls within a preselected time window of about one second and about six seconds. Furthermore, the present invention provides for automatic release of the solenoid in the event that the hood of the vehicle has been opened and is then closed so that the hood latch can be moved in response to closure of the hood as is normally required in most vehicles. Furthermore, the present invention provides a novel emergency release cable which permits manual operation of the solenoid in order to permit releasing of the hood mechanism in the event of a condition which requires manual activation such as when the vehicle battery has been fully discharged. It will also be understood that the novel locking system of the present invention, although described herein primarily for use in conjunction with hood latch mechanisms of vehicles, can also be used for permitting or preventing the release of other cable control locking apparatus in vehicles such as trunk release mechanisms provided in many vehicles today.

As a result of the applicant's teaching herein, a variety of modifications and additions will be perceived. By way of example, various alternative electronic circuit configurations can be implemented to provide the conditional responses of the solenoid activation mechanism of the present invention without utilizing specific components and circuit design described herein. However, all such modifications and additions are deemed to be within the scope of the present invention which is to be limited only by the claims appended hereto.

I claim:

1. In combination with a vehicle having a hood or trunk lid and an ignition switch, a solenoid activated locking system primarily for selectively enabling and disabling remote manual release devices in the vehicle permitting the opening of the hood or trunk lid by the release of a latch from the interior of the vehicle; the locking system comprising:

a solenoid;

means controlled by said solenoid for engaging said latch and selectively preventing and enabling activation of said latch by said manual release device; and means controlling said solenoid and responsive to limited access switching within said vehicle interior for selectively activating said solenoid;

said solenoid controlling means comprising means responsive to each of the following events for activating said solenoid:

(a) turning the ignition switch of said vehicle ON;

(b) turning the ignition switch of said vehicle OFF;

(c) activating said limited access switching means for a period of time greater than a selected minimum and less than selected maximum after said vehicle ignition switch has been turned ON for a selected minimum period of time; and (d) closing said lid.

2. The locking system recited in claim 1 further comprising means for manually releasing said solenoid in the event that said solenoid controlling means is non-operative.

3. The locking system recited in claim 1 wherein said solenoid controlled means comprises a cable interconnected to said latch.

4. The locking system recited in claim 1 wherein said limited access switching comprises the ignition lock of said vehicle.

5. The locking system recited in claim 4 wherein said limited access switching further comprises a switch within said vehicle and having another principal switching function.

6. The locking system recited in claim 1 wherein said solenoid controlling means activates said solenoid for a preselected period of time before automatically deactivating said solenoid.

7. The locking system recited in claim 1 wherein said solenoid controlling means comprises a logic circuit electrically interposed between said solenoid and said limited access switching.

* * * * *